US005647195A

United States Patent [19]

Josoff

[11] Patent Number: 5,647,195

[45] Date of Patent: Jul. 15, 1997

[54] METHOD FOR TWISTING A PAIR OF MOVING STRANDS

[75] Inventor: Peter Larry Josoff, Omaha, Nebr.

[73] Assignee: Lucent Technologies Inc., Murray Hill, N.J.

[21] Appl. No.: 496,555

[22] Filed: Jun. 29, 1995

[51] Int. Cl.[6] ..... D01H 1/04; D01H 5/00

[52] U.S. Cl. ..... 57/67; 57/66; 57/115; 57/116; 57/127.5; 57/129; 57/293; 57/294; 242/364

[58] Field of Search ..... 242/364; 57/204, 57/293, 294, 66, 66.5, 67, 68, 115, 116, 127.5, 129

[56] References Cited

U.S. PATENT DOCUMENTS

| | | | |
|---|---|---|---|
| 2,461,576 | 2/1949 | Stanley | 28/71.6 |
| 2,508,504 | 5/1950 | Esmond | 28/71.7 |
| 2,558,834 | 7/1951 | Esmond | 28/71.7 |
| 2,558,835 | 7/1951 | Esmond | 28/71.5 |
| 2,558,836 | 7/1951 | Esmond | 28/71.7 |
| 2,622,860 | 12/1952 | Lorig | 263/3 |
| 2,677,949 | 5/1954 | Dixon | 68/19 |
| 3,052,079 | 9/1962 | Henning | 57/34 |
| 3,163,372 | 12/1964 | Goldman et al. | 242/47.08 |
| 3,373,550 | 3/1968 | Symonds | 57/34 |
| 3,413,793 | 12/1968 | Stine et al. | 57/68 |
| 3,460,334 | 8/1969 | Lawrenson et al. | 57/293 |
| 3,589,118 | 6/1971 | Strelow et al. | 57/294 |
| 3,659,408 | 5/1972 | Burr | 57/294 |
| 3,664,108 | 5/1972 | Strelow et al. | 57/294 |
| 3,709,444 | 1/1973 | Tannert | 242/47.04 |
| 3,782,092 | 1/1974 | Vogelsberg | 57/294 |
| 3,823,536 | 7/1974 | Vogelsberg et al. | 57/34 |
| 4,006,582 | 2/1977 | Gurkaynak et al. | 57/34 |
| 4,182,107 | 1/1980 | Carter et al. | 57/293 |
| 4,214,432 | 7/1980 | Scheidt | 57/293 |
| 4,317,329 | 3/1982 | Roberge | 57/294 |
| 4,328,664 | 5/1982 | Vogelsberg et al. | 57/293 |
| 4,553,709 | 11/1985 | Bock et al. | 242/47.01 |
| 4,818,311 | 4/1989 | Boehlke et al. | 156/51 |
| 4,850,400 | 7/1989 | Gorris | 139/452 |
| 4,873,393 | 10/1989 | Friesen et al. | 174/34 |
| 5,092,117 | 3/1992 | Paivinen et al. | 57/293 |
| 5,211,207 | 5/1993 | Ichikawa | 139/452 |
| 5,237,809 | 8/1993 | Oestreich et al. | 57/204 |

FOREIGN PATENT DOCUMENTS

| | | |
|---|---|---|
| 1552618 | 1/1969 | France . |
| 3423342 | 1/1986 | Germany . |
| 3717295 | 12/1988 | Germany . |
| 92019524 | 11/1992 | WIPO . |
| 9508175 | 3/1995 | WIPO . |

OTHER PUBLICATIONS

Frank W. Horn, Cable, Inside & Out, 4–7, 11–13 (1977).

*Primary Examiner*—William Stryjewski
*Attorney, Agent, or Firm*—Michael A. Morra

[57] ABSTRACT

A method for twisting a pair of moving strands uses a winder assembly 510, which is mounted on a first shaft 140 and rotates around a cylindrical drum 110. Twisted wire is wrapped in adjacent convolutions around an exterior surface of the cylindrical drum, which is mounted on a second shaft 150. The exterior surface is energized to advance the convolutions from its input end to its output end; and an unwinder assembly 520 is mounted on a third shaft 160 at the output end of the drum. The shafts are coaxial with each other and each is capable of independent rotational movement. The volume of strand material stored on the drum may be varied by changing the relative rotational speeds and directions of the different shafts. A twist in one direction is imparted onto the strand pair when the number of convolutions stored on the drum is increased; and a twist in the opposite direction is imparted onto the strand pair when the number of convolutions stored on the drum is decreased. By periodically changing the rotation direction of the winder and/or the unwinder, an S-Z twist pattern is imparted onto the strand pair.

12 Claims, 9 Drawing Sheets

METHOD FOR TWISTING A PAIR OF MOVING STRANDS

CROSS REFERENCE TO RELATED APPLICATIONS

This invention is related to U.S. Ser. No. 08/496,638, and U.S. Ser. No. 08/496,792, both to Peter L. Josoff filed concurrently with this patent application.

TECHNICAL FIELD

This invention relates to a method for twisting strand materials such as wire, fiber or yarn; and more particularly to a method for imparting an alternating succession of twists to a plurality of advancing parallel strands.

BACKGROUND OF THE INVENTION

In the manufacture of cables for use in the telephone industry, it is usually necessary to intertwist a pair of individually insulated wires to form a twisted pair. A plurality of the twisted pairs are then fed into a strander and associated together into stranded units. In twisting operations, either the wire supply or the take-up device is rotated about the axis of the advancing wires in order to impart a unidirectional twist onto the wires. One reason for twisting wire pairs is to cancel noise emanating from an external source. When equal and opposite noise signals are coupled into a twisted wire pair, the net effect is noise cancellation. Similarly, crosstalk among wire pairs within the same stranded unit can be avoided when different amounts of twist are imparted onto each twisted pair. In this regard, a number of different twisting arrangements have been devised—some more effective than others. For example, U.S. Pat. No. 4,873,393 discloses a cable that achieves extremely low crosstalk by tightly twisting the wire pairs and by varying the twist lengths among the different wire pairs in accordance with the principles of non-uniform, twist-frequency spacing.

It is desirable, although topologically impossible, to perform unidirectional twisting without rotating the wire supply or the take-up device about an axis of rotation. Unidirectional twisting generally involves the use of heavy rotating apparatus which is burdensome from a manufacturing standpoint. However, it has been found that unidirectional twisting is not necessary in most applications. Methods have been devised for forming twisted wire pairs without the need for rotating the wire supply or take-up device by periodically reversing the direction of twist imparted to an advancing group of wires. This has become known as S-Z twisting with S referring to left-hand twists and Z referring to right-hand twists. It is usually performed with apparatuses known as accumulators which have spaced-apart twister heads. Each twister head normally has one or more sheaves rotatably mounted to a head support which itself is mounted for revolution about the axis of two or more strands advancing side-by-side through the accumulator. An example is shown in U.S. Pat. No. 4,182,107 wherein a pair of strands are pulled through a strand spreader in the form of a die having two laterally spaced passageways through which the individual strands pass. The strands pass over a pair of spaced-apart twister heads through a capstan and onto a take-up device. The twister heads are simultaneously revolved about the longitudinal axis of the strands in one direction causing the strands to become twisted between the strand-spreader die and the first twister head. Simultaneously, twists of the opposite lay direction emanate from the second twister head downstream of the twister toward the take-up device.

One method for S-Z twisting uses a device known as a variable capacity, in-line accumulator—an example of which is shown in U.S. Pat. No. 3,052,079. With this type of accumulator the twister heads are moved in unison up and down an advancing line of strands while the speed of advance of the strands, and the speed of revolution of the twister heads thereabout, are both maintained constant. Other examples of S-Z twisting are shown in U.S. Pat. Nos. 3,373,550 and 3,782,092. And while the above examples avoid the need for rotating the strand supply or the take-up device, they still require a substantial amount of apparatus and the span between twist reversals is relatively short. Twist reversals generally require that the wire pair be gripped at the reversal point to avoid unraveling,—an added complexity when short twist spans are used.

What is needed, and what seemingly is not available in the art, is a method for twisting strand materials without rotating the strand supply or the take-up device, and which delivers a longer span of unidirectional twist.

SUMMARY OF THE INVENTION

The foregoing problems of the prior art have been overcome with a novel method for twisting a strand pair which, in an illustrative embodiment, is first moved through a winder assembly. The winder assembly is rotated around a central axis to impart one twist for each 360 degrees of rotation onto the strand pair. Thereafter, convolutions of the strand pair are deposited onto an input end of a storage structure which includes a movable exterior surface. The exterior surface is energized to advance convolutions of the twisted strand pair from the input end of the storage structure to its output end in a longitudinal direction which is parallel to the central axis. The twisted strand pair is then moved from the output end of the storage structure onto a take-up device. It is noted that the winder assembly can be replaced by an unwinder assembly which also rotates around the central axis to impart one twist for each 360 degrees of rotation onto the strand pair as it removes it from the support structure.

In illustrative embodiments of the invention, the storage structure is rotated around the central axis. However, such rotation is unnecessary when a winder assembly and an unwinder assembly are present. Here, the volume of strand material stored on the support structure is varied by changing the relative rotational speeds and directions of the winder and unwinder assemblies. A twist in one direction is imparted onto the strand pair when the volume stored on the support structure is increased; and a twist in the opposite direction is imparted onto the strand material when the volume stored on the support structure is decreased. By rotating the winder and unwinder assemblies in opposite directions, the volume of strand material stored on the support structure is quickly increased or decreased. And by periodically reversing the rotation direction of the winder and/or the unwinder, the twist direction is also periodically reversed—thereby delivering what is known as an S-Z twist pattern.

Because the novel support structure used herein holds such a large volume of strand material, it is possible to fill the entire structure with a wire pair having a unidirectional twist. Alternatively, if the support structure is filled with an untwisted wire pair, then the unwinder assembly can be used to impart a unidirectional twist when removing it from the support structure. In either event, mid-span unidirectional twisting can be accomplished for substantially longer lengths than have been possible heretofore.

BRIEF DESCRIPTION OF THE DRAWING

The invention and its mode of operation will be more clearly understood from the following detailed description when read with the appended drawing in which.

DETAILED DESCRIPTION

Figure 1:
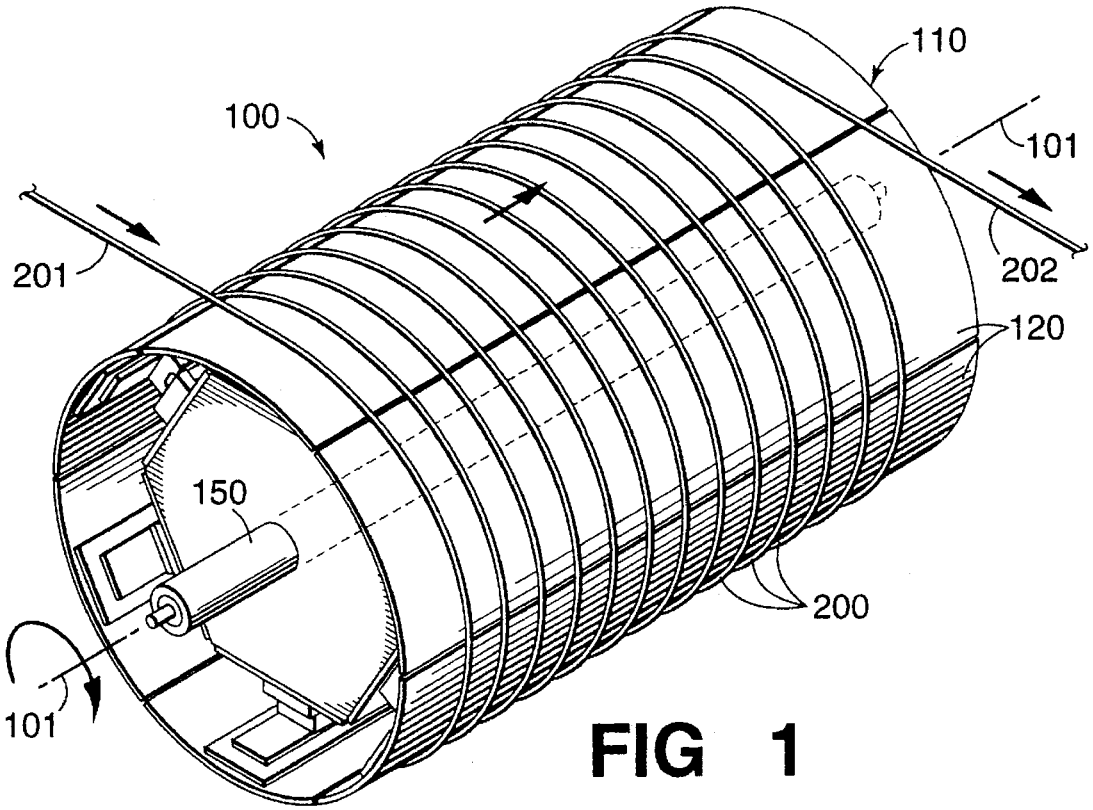
FIG. 1 is a simplified perspective view of a line juxtapositioner in accordance with the invention.

FIG. 1 is a simplified perspective view of a line juxtapositioner 100 which will be used to generally describe its key feature; namely, its ability to store a volume of moving strand material 200 thereon while advancing same from one end thereof to the other. The line juxtapositioner shown in FIG. 1 comprises drum 110 supported by drum shaft 150 which enables the drum to rotate about central axis 101—101. The drum 110 itself comprises one or more segments 120 (six are shown here) which are capable of movement apart from the rotation of the dram. And although there are numerous specific ways in which such movement can be achieved, it is preferable to use cyclic movements of the one or more segments 120 which form an exterior surface ("skin") of the drum. In this example embodiment, each segment is independently moveable.

The direction of rotation is illustratively shown in the clockwise direction which causes input strand material 201 to be pulled onto the drum and output strand material 202 to exit the drum. Because each rotation of the drum causes the same amount of material to enter and exit the drum, a constant number of convolutions of strand material 200 are maintained on the drum. As a practical matter, a winder 310 (see FIG. 3) is used to load the drum and establish a constant volume condition. In subsequent drawings, it will be shown that winders and unwinders can be used to dynamically increase or decrease the volume of material stored on the drum—thereby providing the line juxtapositioner with improved versatility.

Only a single layer of strand material is stored on the drum so that it can be easily deposited and removed therefrom; nevertheless, a substantial quantity of material can be accumulated on the drum which is dependent on its dimensions and the thickness of the strand material. For example, a drum which has a two-foot diameter and is two feet long can theoretically store over 4000 feet of 24 AWG insulated conductor (667 convolutions of insulated wire whose outside diameter is about 36 mils).

Figure 2:
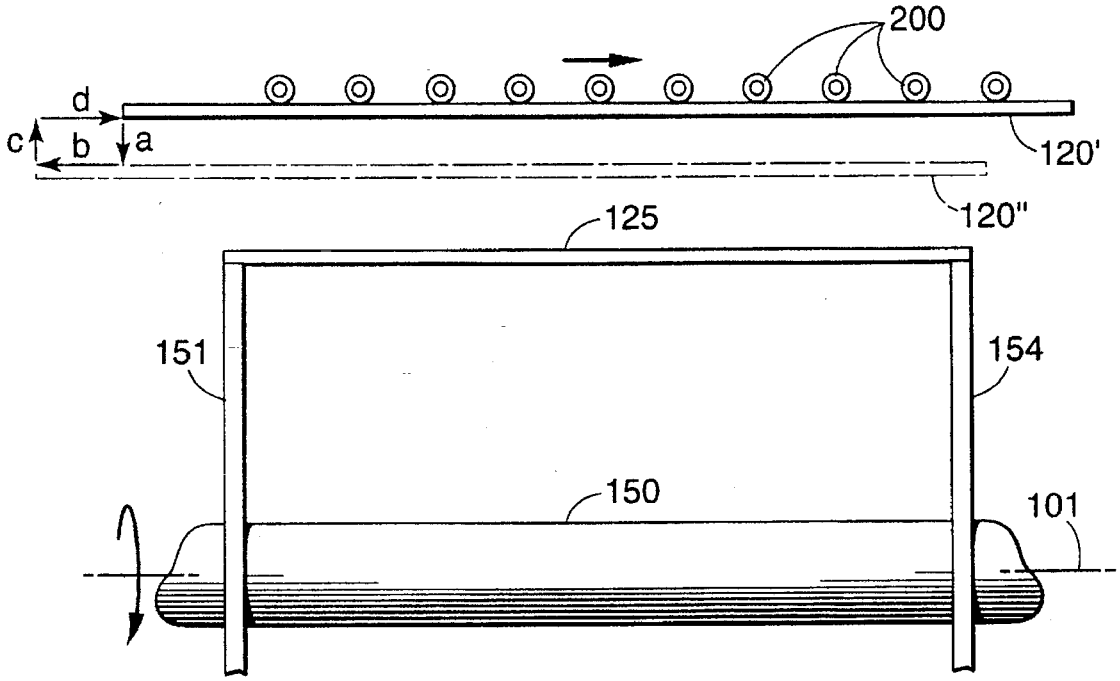
FIG. 2 is a cross-section view of the line juxtapositioner showing the locus of a point located on its exterior surface.

As shown in FIG. 2, the drum segment is energized to move in a clockwise manner (a-b-c-d) which tends to advance strand material 200 from left to right across the drum surface. The apparatus which causes this motion is discussed in connection with FIG. 7–12, but is omitted from this introductory discussion. The motion of the drum segment, which ultimately advances the strand material, can be best understood by considering the locus of a point shown on the left-hand side of the segment. In particular, rectangular motion (a-b-c-d) of the point is illustrated. During movement "a," the drum segment moves from its initial location, denoted 120', toward the central axis 101 of the drum (i.e., away from the strand material 200). During movement "b," the drum segment moves laterally from right to left while it is not in contact with the strand material. At the end of movement "b" the position of the drum segment is in a location denoted 120". During movement "c," the drum segment moves away from the central axis 101 of the drum (i.e., toward the strand material 200). And during movement "d," the drum segment moves laterally from left to right while it is in contact with the strand material—thereby advancing the strand material incrementally to the right. At the end of movement "d" the drum segment is in its initial location 120'. The above-described motion of the drum segment is energized by apparatus that resides between the segment and mounting plate 125. The drum segment is mechanically linked to mounting plate 125 which, in turn, is linked to shaft 150 via plate support members 151–154. As the shaft rotates, so too does the drum segment.

Figure 3:
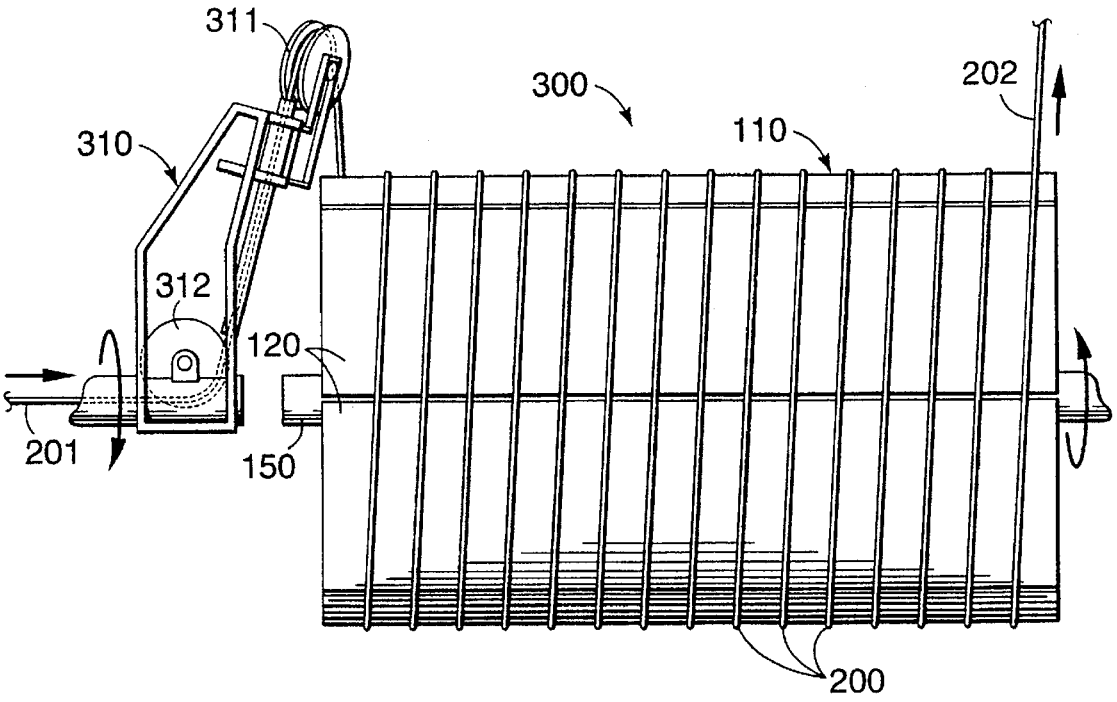
FIG. 3 shows a line juxtapositioner comprising a drum and a winder that enables strand material to be received at a variable input speed while delivering same at a constant output speed.

FIG. 3 discloses a line juxtapositioner 300 comprising a drum 110 and a winder 310. The line juxtapositioner receives input strand material 201 at one end of the drum and delivers output strand material 202 at the other end of the drum. Strand material is initially loaded onto the drum by rotating the winder 310 in the direction shown, but not rotating the drum itself. In order to advance the convolutions of strand material 200 from one end of the drum to the other (left-to-right in FIG. 3), segments 120—120 are energized in the manner described hereinafter. Once the desired amount of strand material is loaded, the drum is rotated in the direction shown by rotating shaft 150; and assuming that the drum rotation speed is constant, the output speed of the strand material is also constant. In one application, the winder 310 stops rotating after the drum is loaded and the drum begins to rotate. However, in the event that input strand material 201 being received by line juxtapositioner 300 changes speed (perhaps due to variations in production rate), winder 310 can compensate by rotating in the direction shown (to accommodate a speed decrease) or by rotating in a direction which is opposite the direction shown (to accommodate a speed increase). In this manner, a constant delivery speed of output strand material 202 can be maintained. Upstream variations in the flow of strand material can be completely compensated (for a limited time) by controlling the rotation speed and direction of winder 310.

Figure 4:
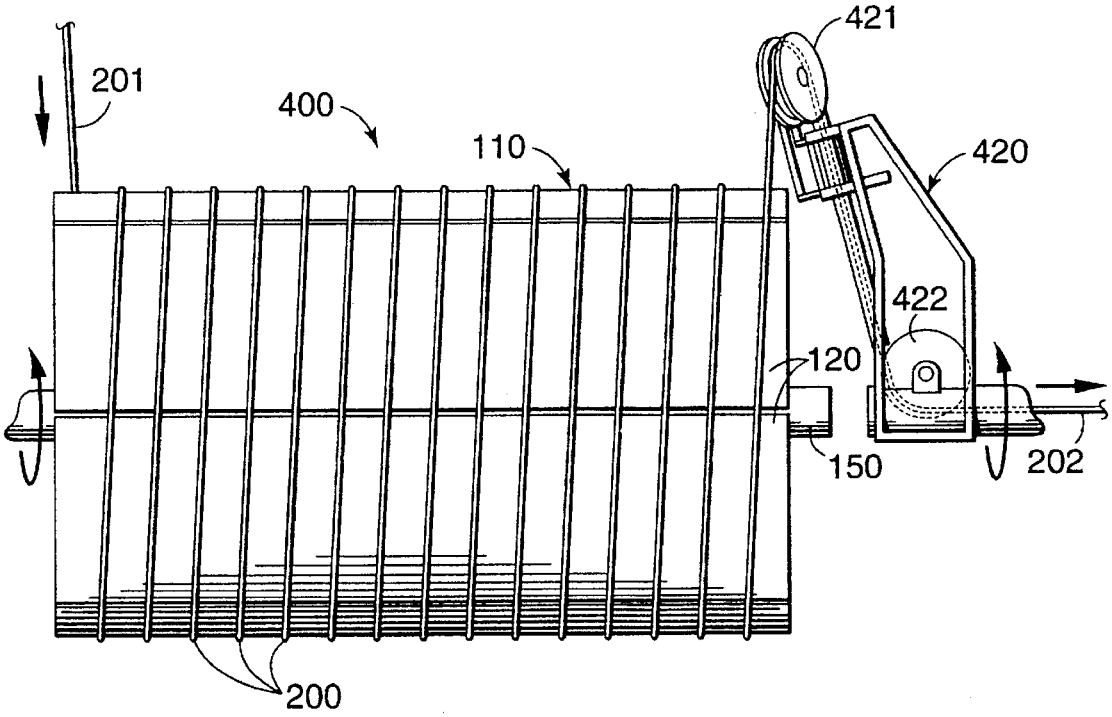
FIG. 4 shows a line juxtapositioner comprising a drum and an unwinder that enables strand material to be delivered at a variable output speed while receiving same at a constant input speed.

FIG. 4 discloses a line juxtapositioner 400 comprising a drum 110 and an unwinder 420. Similar to FIG. 3, the line juxtapositioner receives input strand material 201 at one end of the drum and delivers output strand material 202 at the other end of the drum. FIG. 4 illustrates the situation wherein strand material 201 enters drum 110 at a constant input speed but may be removed at a variable output speed. If, for example, the strand material 201 being delivered to line juxtapositioner 400 changes, and drum rotation needs to speed up, unwinder 420 can compensate by rotating in the direction shown to maintain the same output delivery speed of strand material 202. Alternatively, unwinder 420 can be rotated in a direction which is opposite the direction shown to increase the output delivery speed of strand material 202. Downstream flow of strand material can be completely regulated (for a limited time) by controlling the rotation speed and direction of unwinder 420.

Figure 5:
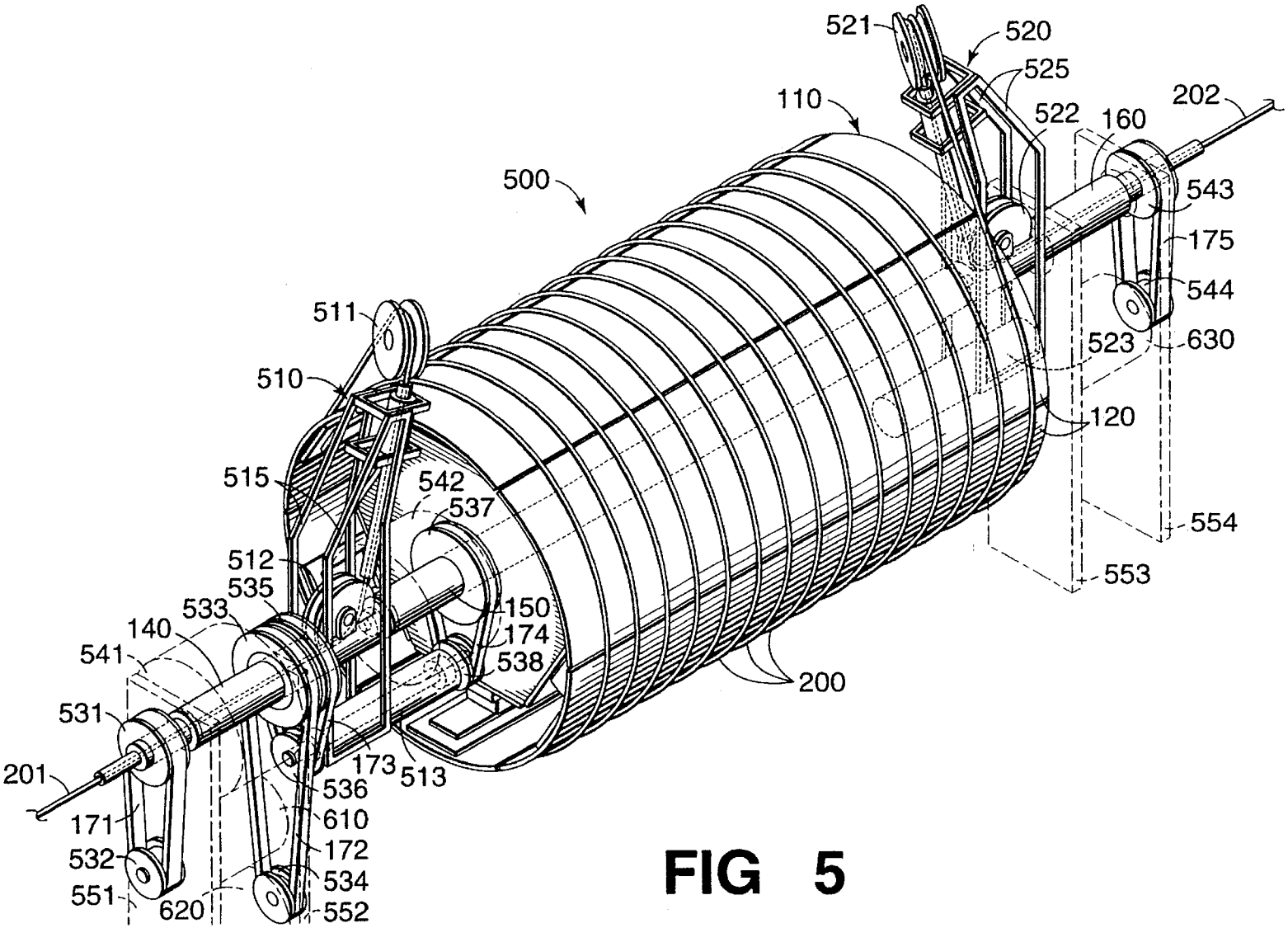
FIG. 5 is a detailed perspective view of a line juxtapositioner comprising a drum, a winder, and an unwinder.
Figure 6:
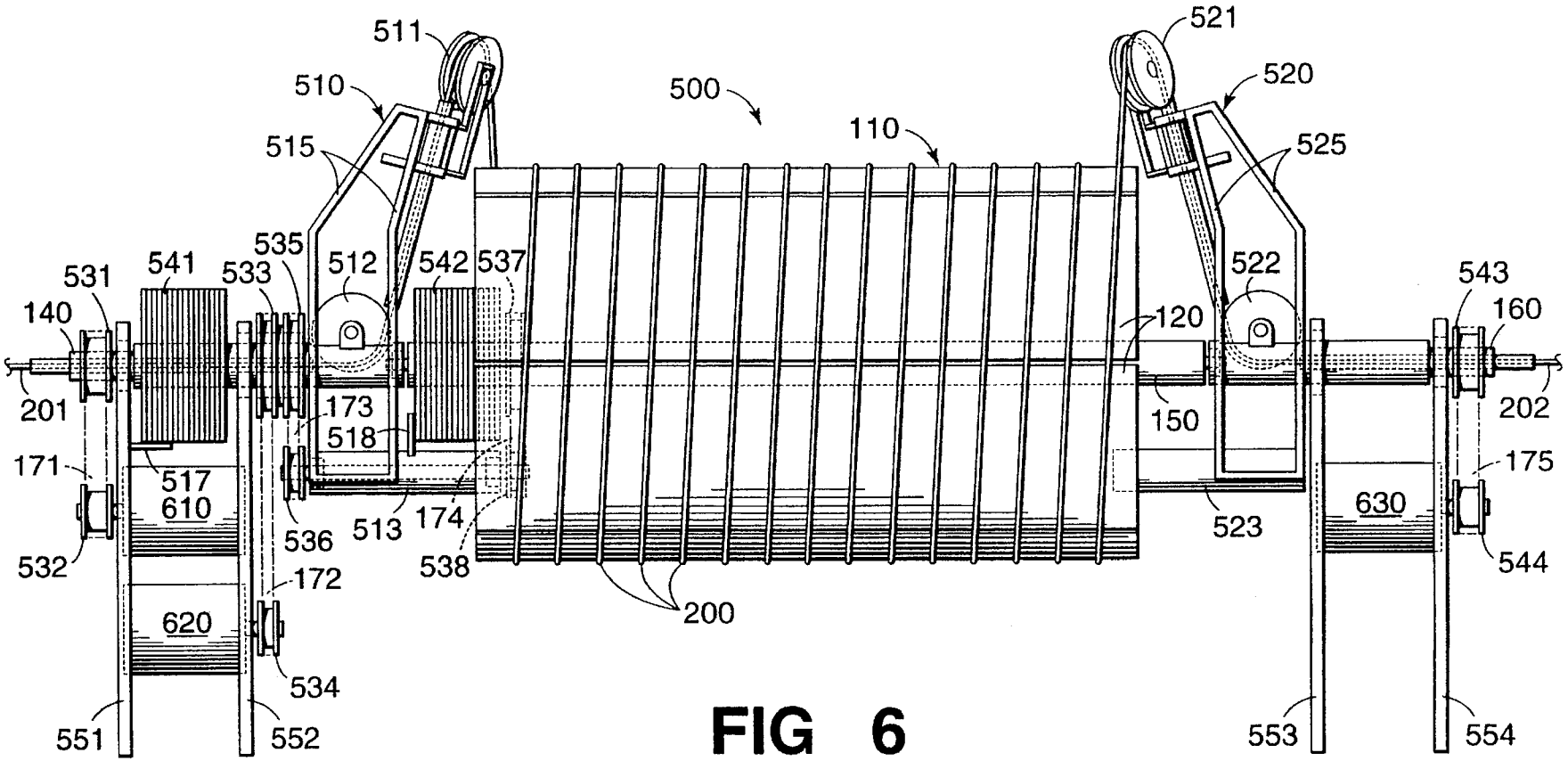
FIG. 6 is a detailed side view of the line juxtapositioner shown in FIG. 5.

Reference is now made to FIG. 5 and FIG. 6 which show detailed views of line juxtapositioner 500 comprising a drum 110, a winder assembly 510, and an unwinder assembly 520. Pillars 551–552 include bearings (not shown) that function to support shaft 140 and to facilitate the rotation of winder assembly 510. Similarly, pillars 553–554 include bearings (not shown) which function to support shaft 160 and to facilitate the rotation of unwinder assembly 520. Drum shaft 150 is connected at one end to shaft 140 via internal bearings; and is connected at its other end to the shaft 160 via internal bearings. Accordingly, each of the shafts (140, 150, 160) is capable of independent rotation with respect to the other.

Rigidly mounted on shaft 140 are winder pulley (sheave) 531, slip ring assembly 541, and winder assembly 510. When the winder pulley is rotated, the slip ring assembly and the winder assembly are similarly rotated. Shaft 140 includes an axial bore which enables input strand material 201 to be delivered to the winder assembly 510 while the shaft is rotating without twisting the strand material. Additionally, brush contacts 517 are mounted on pillar 551 in order to deliver electrical power to the slip ring assembly 541 while the drum and/or the winder assembly are rotating. Such electrical power is used by apparatus within the drum 110 to activate the drum segments 120. The slip ring assembly 541 is shown having a plurality offings so that each drum segment can, for example, be energized independently. A groove along the outside surface of shaft 140 (not shown) is used to route wires from slip ring assembly 541 (mounted on winder shaft 140) to slip ring assembly 542 (mounted on drum shaft 150). These wires terminate in brush contacts 518 that extend into slip ring assembly 542.

Winder Rotation

Motor 610 is shown mounted between pillars 551–552 in FIG. 6, and is energized in order to rotate the winder assembly 510. Attached to the output of motor 610 is a drive pulley 532 which is interconnected to pulley 531 via drive belt 171. When pulley 531 rotates, shaft 140 and winder assembly 510 also rotate. A housing 515 surrounds the winder assembly although only its edges are shown in FIGS. 5 and 6 to reveal the internal structure. In particular, the winder assembly 510 includes pulleys 511–512 which are mechanically held by the housing 515, and cooperate to deliver strand material to the external surface of the drum 110. Pulley 511 is frequently referred to as a strand-payout member. Pulleys 536 and 538 are rigidly mounded on a shaft 513 whose outside surface is covered with a sleeve. One belt 173 connects pulley 535 to pulley 536; and another belt 174 connects pulley 537 to pulley 538. The housing 515 attaches to the sleeve on shaft 513 so that when the winder assembly 510 rotates around the central axis of the line juxtapositioner 500, so too does shaft 513. In FIG. 6, for example, as pulley 511 moves away from the viewer (i.e., into the page), shaft 513 moves toward the viewer. Such rotation of the winder assembly 510 does not impart any rotation to the drum 110. Note that pulleys 533 and 535 are mechanically joined together and attached to shaft 140 via bearings. These pulleys are linked to, and held rigid by, the output of drum drive motor 620 as discussed below.

Drum Rotation

Motor 620 is shown mounted between pillars 551–552 in FIG. 6, and is energized to rotate the drum 110. Attached to the output of motor 620 is a drive pulley 534 which ultimately rotates drum shaft 150. This is accomplished via mechanical interlinking among pulleys 533–538 as discussed herein. Pulleys 533 and 534 are linked together via belt 172 so that any rotation of pulley 534 causes pulley 533 to rotate. Pulleys 533 and 535 are mechanically joined together, but are mounted on shaft 140 via bearings. These pulleys (533, 535) rotate together, but are substantially independent of any rotation by shaft 140. Pulleys 535 and 536 are linked together via belt 173 so that any rotation of pulley 535 causes pulley 536 to rotate. It is noted that the winder assembly 510 is precluded from moving at this time because shaft 140 is held rigid by winder drive pulley 531 (i.e., is controlled by motor 610 which drives the winder assembly). Pulleys 538 and 537 are linked together via belt 174, and since pulley 537 is rigidly attached to the drum shaft 150, any rotation of pulley 538 causes the drum shaft to rotate.

Unwinder Rotation

Motor 630 is shown mounted between pillars 553–554 in FIGS. 5 and 6, and is energized in order to rotate the unwinder assembly 520. Attached to the output of motor 630 is a drive pulley 544 which is interconnected to pulley 543 via drive belt 175. When pulley 543 rotates, shaft 160 and unwinder assembly 520 also rotate. A housing 525 surrounds the unwinder assembly although only its edges are shown in FIGS. 5 and 6 to reveal the internal structure. In particular, the unwinder assembly 520 includes pulleys 521–522 which are mechanically linked to the housing 525, and cooperate to take up strand material from the external surface of the drum 110. Pulley 521 is frequently referred to as a strand-receiving member. The housing 525 attaches to a mass 523 so that when the unwinder assembly 520 rotates around the central axis of the line juxtapositioner 500, so too does mass 523. In FIG. 6, for example, as pulley 521 moves away from the viewer (i.e., into the page), mass 523 moves toward the viewer (i.e., toward the viewer). Mass 523 is used to counterbalance the remaining mass of the unwinder assembly 520 so that the overall center of gravity lies on the axis of rotation. Shaft 160 includes an axial bore which enables output strand material 202 to exit the unwinder assembly 520 while the shaft is rotating.

Figure 7:
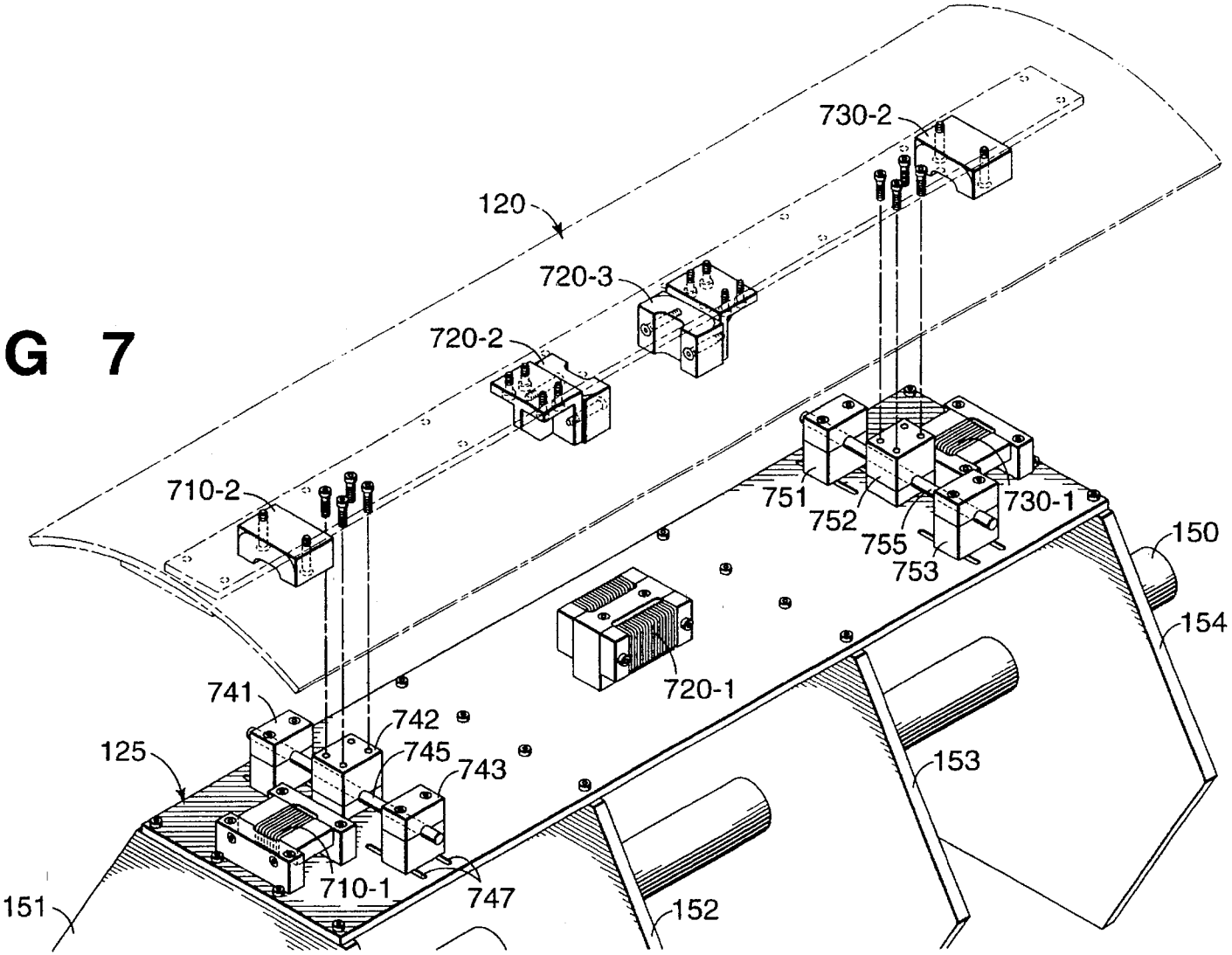
FIG. 7 shows an exploded isometric view of one segment of the drum illustrating the electrical and mechanical interconnection between the exterior surface and its associated mounting plate.

FIG. 7 shows an exploded isometric view of one segment 120 of the drum illustrating the mechanical interconnection between the segment and its associated mounting plate 125. One mechanical connection is made to the segment 120 via block 742 which, in turn, is mechanically connected to mounting plate 125 via flexible steel rod 745 and blocks 741,743. Another mechanical connection is made to the exterior surface 120 via block 752 which, in turn, is mechanically connected to mounting plate 125 via flexible steel rod 755 and blocks 751,753. The dimensions and material used in rods 745 and 755 are identical and are designed to allow surface 120 to move with respect to mounting plate 125. Moreover, they are used to change the resonance frequency of the exterior surface 120. For example, the distance between blocks 741 and 743 (and hence the operating length of rod 745) can be changed by repositioning block 743 at a different location in slots 747. Changes in the operating length of the rod 745 affects the vertical and horizontal resonance frequencies of surface 120.

Figure 12:
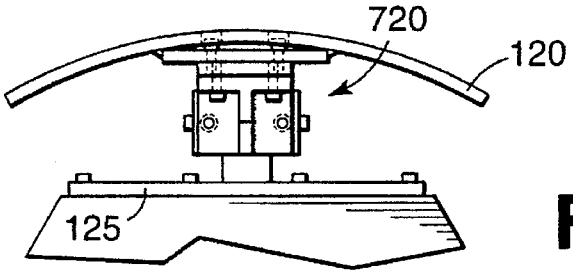
FIG. 12 is yet another end view of FIG. 9 showing the electromagnet which moves one of the segments in a direction parallel to the plane of the segment.

FIG. 7 also illustrates the electrical interconnection between the exterior surface 120 and its associated mounting plate 125. Three electromagnets 710, 720, 730 are used for moving the surface in two directions. Horizontal movement (i.e., parallel to drum shaft 150) is controlled by electromagnet 720 comprising winding section 720-1 which is mounted on mounting plate 125, and pole portions 720-2, 720-3 which are mounted on segment 120. FIG. 12 shows an end view of electromagnet 720 to further illustrate its partial attachment to segment 120 and mounting plate 125. Vertical movement (i.e., perpendicular to surface 120) is controlled by electromagnets 710 and 730. Electromagnet 710 comprises winding section 710-1 which is mounted to mounting plate 125, and pole portion 710-2 which is mounted to surface 120. Similarly, electromagnet 730 comprises winding section 730-1 which is mounted on mounting plate 125, and pole portion 730-2 which is mounted on surface 120. Finally, segment 120 is joined to the drum shaft 150 via plate support members 151–154 (see also FIG. 9).

Figure 8:
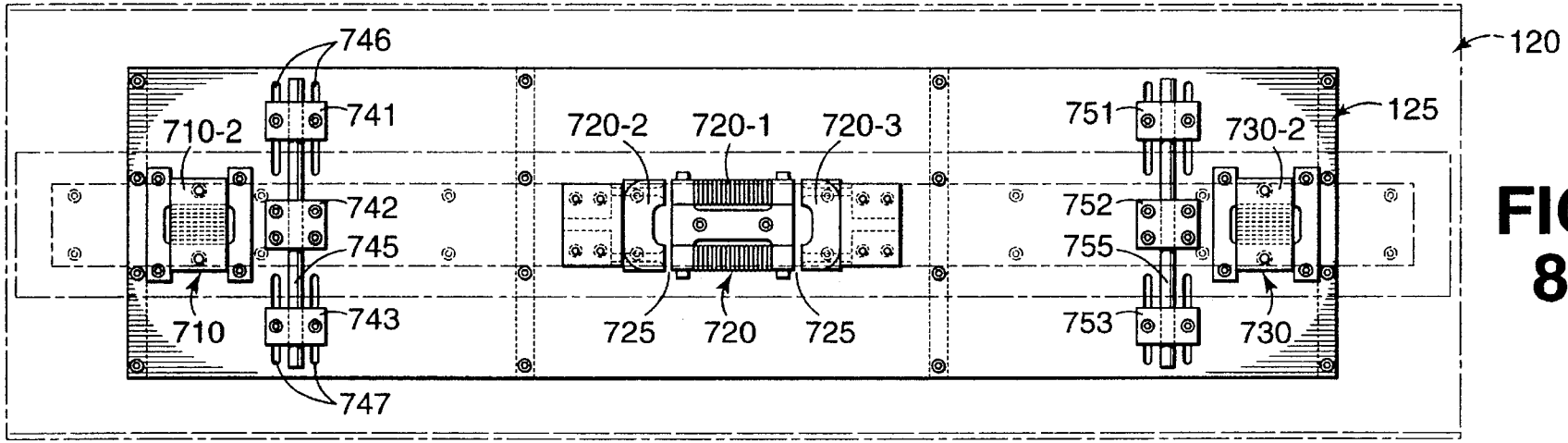
FIG. 8 is a top view of one segment of the drum with the exterior surface and associated mounting plate interconnected.
Figure 10:
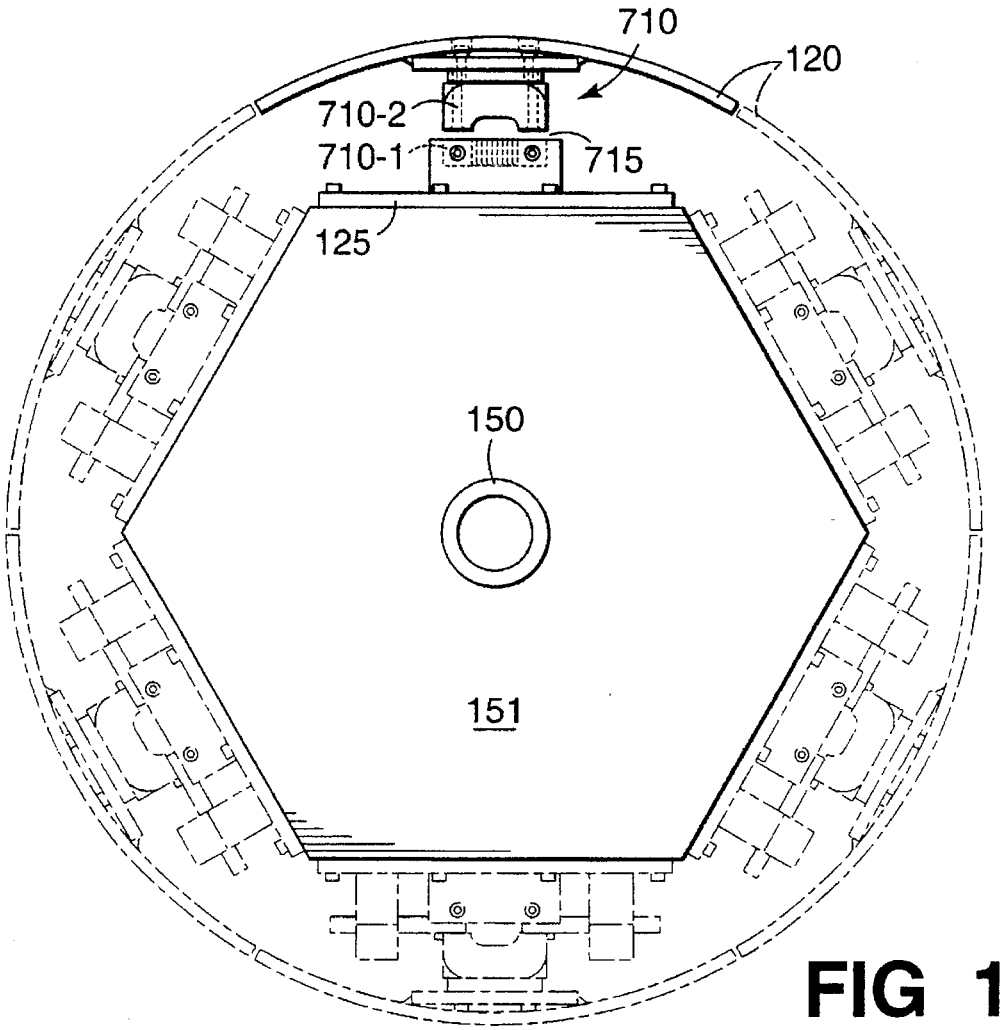
FIG. 10 is an end view of FIG. 9 generally showing a cylindrical drum comprising six segments, and particularly showing an electromagnet which moves one of the segments in a vertical direction.

FIG. 8 is a top view of one segment of the drum with the exterior surface 120 and associated mounting plate 125 interconnected. Electromagnets 710 and 730 are electrically powered in parallel with each other in order to move the exterior surface 120 toward the viewer and away from the viewer of FIG. 8. Electromagnet 720 is electrically powered to move the exterior surface 120 to the left and right as viewed in FIG. 8. In particular, winding portion 720-1 of electromagnet 720 is mounted on mounting plate 125, and pole portion 720-2 is mounted on exterior surface 120. Between these portions are gaps 725 whose widths are approximately 0.6 millimeters to allow side-to-side movement. Referring briefly to FIG. 10, winding portion 710-1 of electromagnet 710 is mounted on mounting plate 125, and pole portion 710-2 is mounted on exterior surface 120. Between these portions are gaps 715 whose widths are approximately 0.6 millimeters to allow up-and-down movement. Electrical signals having sinusoidal wave shapes are used to drive the electromagnets. The electrical signals used for driving electromagnets 710 and 730 are phase shifted by 90 degrees with respect to the electrical signal used for driving electromagnet 720. The frequency chosen (illustratively 43 Hz) is selected to take advantage of the mechanical resonance of the surface 120 in order to minimize power consumption. Such mechanical resonance is determined by the mass and shape of the segment 120 together with the manner in which it is mounted onto mounting plate 125. In the example embodiment, each drum segment is about 1.5 meters in length, 0.5 meters wide and 1 cm thick. Cold-rolled steel is used, and the overall weight of segment 120 is about 50 kilograms. It is understood that different materials and dimensions may be used in the present invention in accordance with cost effectiveness and a particular application. For example, an aluminum drum surface might reduce overall weight, but would not be appropriate in certain applications (e.g., annealing copper wire) where the temperatures run too high (i.e., 500° C.–600° C.).

Figure 11:
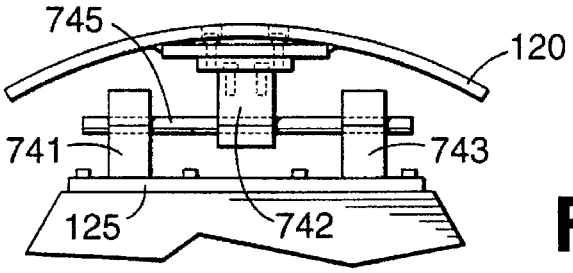
FIG. 11 is another end view of FIG. 9 showing the support rod which flexibly couples one of the segments to the mounting plate.

FIG. 8 together with FIG. 11 illustrate the particular manner in which the exterior surface 120 is mechanically attached to mounting plate 125. Block 742 attaches to the exterior surface 120 while blocks 741,743 attach to one end of mounting plate 125. Each mounting apparatus comprises upper and lower portions which, when clamped together, capture a flexible steel rod 745 therebetween which extends through circular openings in each of the mounting apparatus. A similar arrangement comprising blocks 751–753 and flexible steel rod 755 are positioned at the other end of mounting plate 125. Mounting apparatus 741 and 743 are positioned in slots 746 and 747 respectively so that they can be moved closer together or further apart to change the mechanical resonance as discussed above.

Figure 9:
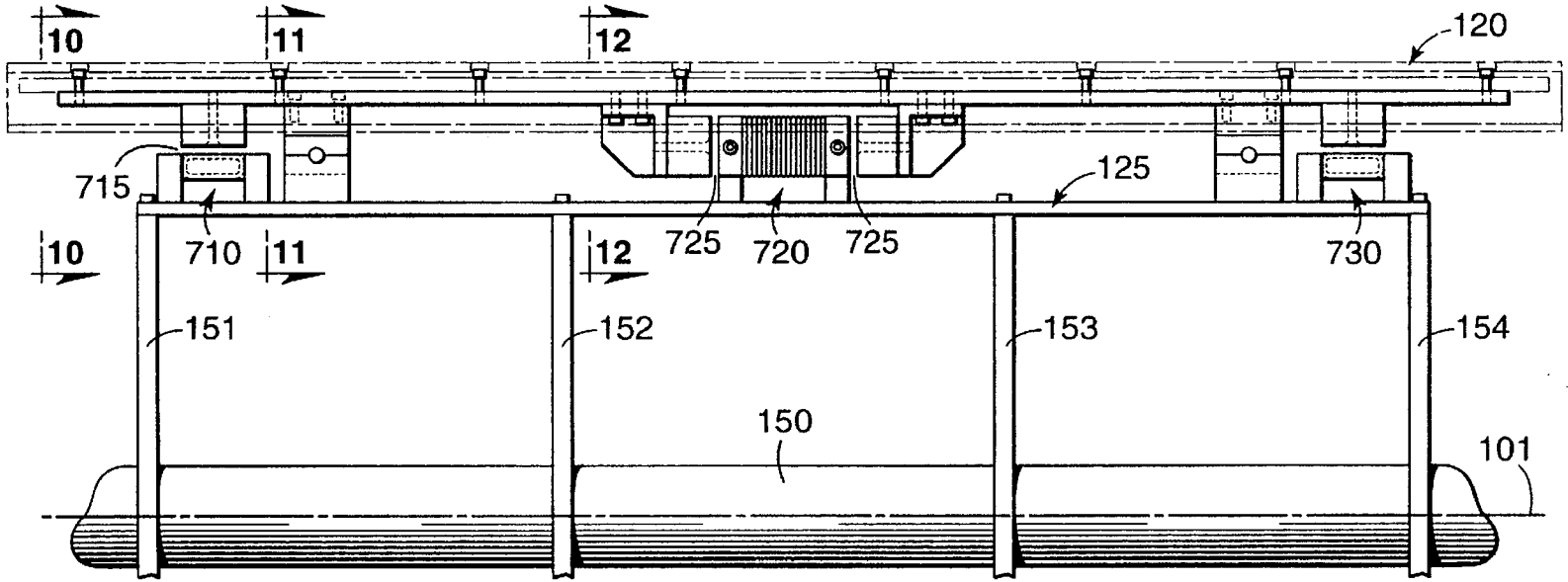
FIG. 9 is a side view of the segment shown in FIG. 8 showing its mechanical attachment to the drum shaft.

FIG. 9 is a side view of the segment shown in FIG. 8 showing its mechanical attachment to the drum infrastructure. In particular, dram shaft 150 resides on central axis 101—101, and is joined to four spaced-apart plate supports 151–154 which, in turn, are joined to mounting plate 125 to form the infrastructure of the drum. Not shown, for the sake of clarity, are the other five mounting plates which complete the drum infrastructure.

FIG. 10 is an end view of FIG. 9 generally showing a cylindrical drum comprising six segments, and particularly showing one of the electromagnets 710 which moves segment 120 in the vertical direction. Each of the six segments 120—120 attaches to an identical mounting plate 125. The mounting plates are connected to drum shaft 150 via hexagonal plate support members 151–154 (see also FIG. 9).

APPLICATIONS

The line juxtapositioner of the present invention can be used in a wide variety of applications. The following uses of the line juxtapositioner are not exclusive, and are offered by way of example.

Annealing

Figure 13:
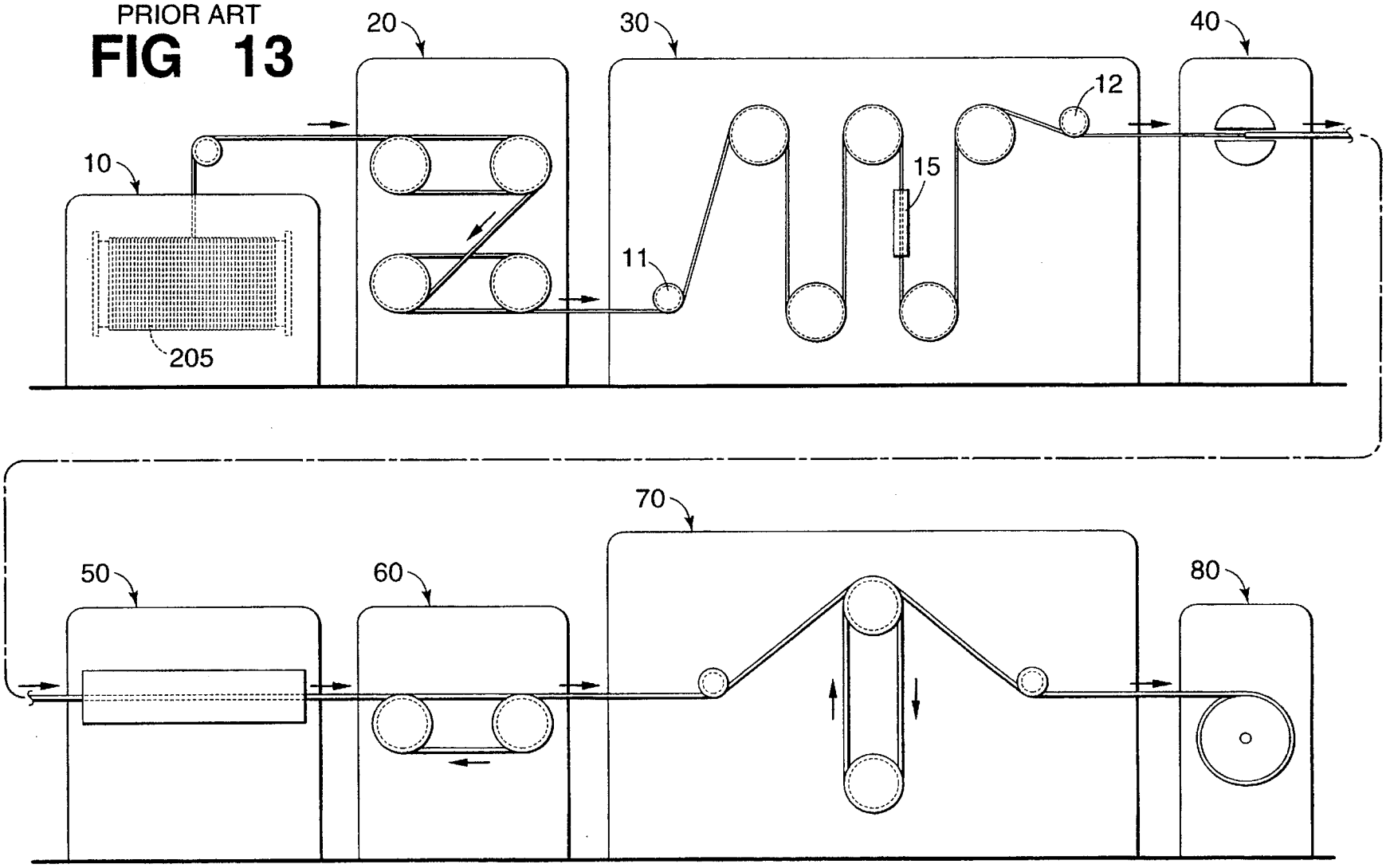
PRIOR ART FIG 13
FIG. 13 is a prior art tandem wire drawing and insulating line.

FIG. 13 discloses a prior art tandem wire drawing and insulating line that includes a number of stations for processing moving copper wire. A description of a known manufacturing line is provided herein, although more details are contained in the book series entitled "*abc of the Telephone*." In particular, reference is made to Vol. 5 entitled "*Cable, inside and out*" by Frank W. Horn; and chapter 4 is specifically incorporated by reference. Briefly, station 10 includes a continuous supply of copper wire (e.g., 12 gauge) wrapped around a supply spool 205 which delivers copper wire to the manufacturing line. As the 12 gauge wire is moved through the wire drawing station 20, its gauge size is reduced (e.g., to 24 gauge) and its grain structure is altered. Such "cold working" increases the number of dislocations through which electrons must travel during the flow of current. As a result, the resistivity of the wire is increased through such cold working and its conductivity is decreased. Annealing is a process in which the wire is heated to cause recovery, recrystallization, grain growth and, ultimately, increased ductility and conductivity.

Station 30 illustrates a know annealer which operates by introducing electrical currents onto various portions of the wire causing it to heat up. This is accomplished by applying different electrical voltages to different sheaves within the annealer. These sheaves not only apply an electrical voltage to the reduced-thickness copper wire, but also allow it to be in continuous movement. For example, pulleys 11 and 12 at the input and output of the annealer are grounded, while the other sheaves have different predetermined voltages applied to them. Such voltages differences cause electrical current to flow in the moving copper wire, thereby heating it. The wire is preheated to about 250° C. before entering steam chest 15 where it reaches temperatures in excess of 500° C. The steam chest provides an environment that keeps the copper wire from discoloring due to oxidation at these temperatures. A water bath at the bottom of steam chest 15 reduces the temperature of the wire before it is exposed to an oxidizing environment. A more detailed description of a known annealer is provided in U.S. Pat. No. 4,818,311. After the wire is annealed, station 40 extrudes a layer of plastic insulation onto the wire, and the insulated wire is then cooled by passing through water trough 50.

Figure 14:
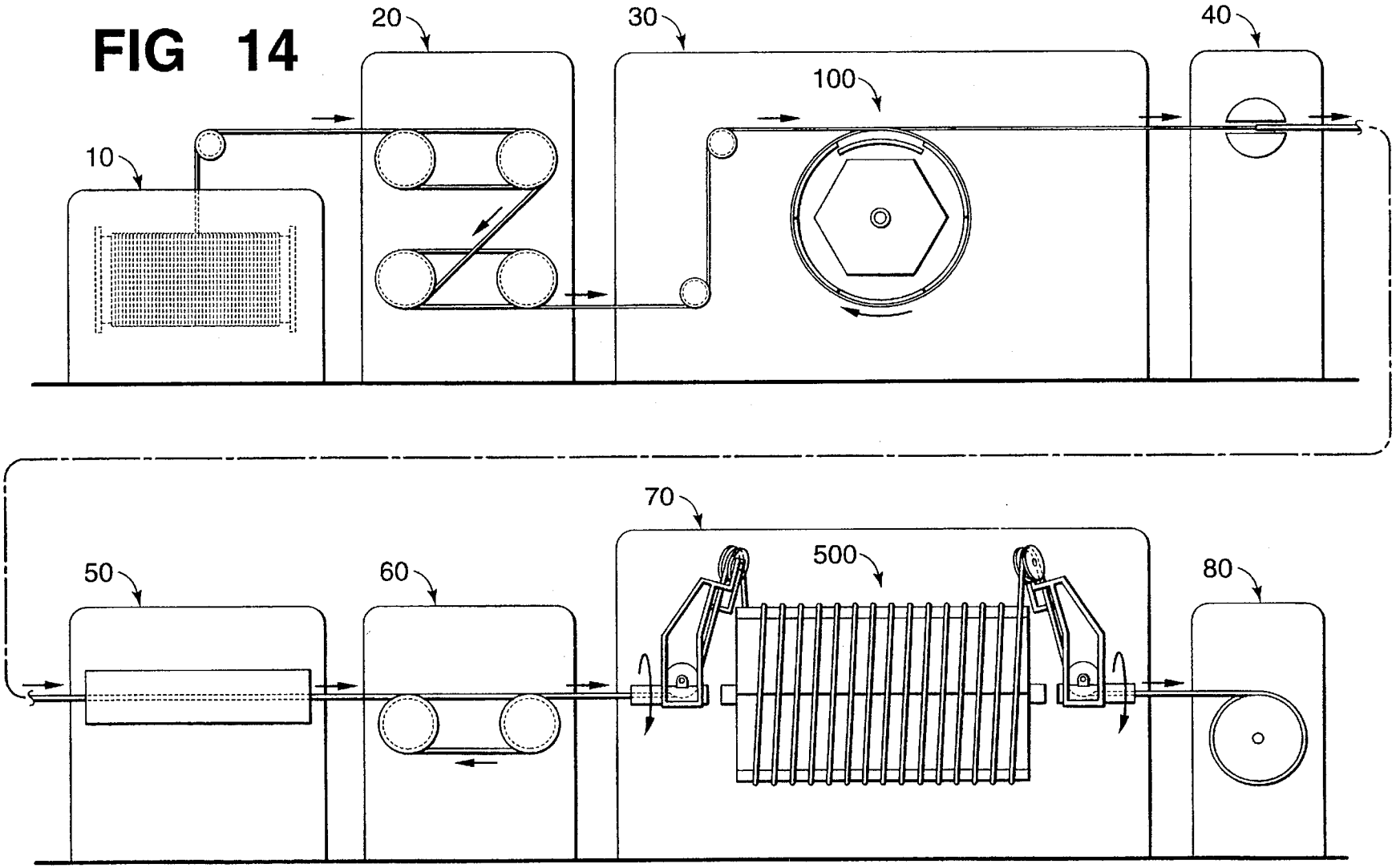
FIG. 14 is a tandem wire drawing and insulating line using the line juxtapositioners of the present invention.

Station 60 comprises a capstan which pulls the insulated wire along at a controlled rate. Take-up station 80 includes a spool onto which the insulated wire is wrapped. Because it may be necessary to stop, or slow down, the moving copper wire due to spool changeover, station 70 is needed to buffer speed variations. Buffer station 70 comprises a "dancer" such as described above and shown in U.S. Pat. No. 3,163,372, and an air-wipe device such as shown in U.S. Pat. No. 2,677,949. An air wipe device directs a blast of air onto wet strand material so that it will be dry before being wound onto the take-up spool. Known air-wipe devices are extremely noisy, but have heretofore been necessary. FIG. 14 discloses improvements to the above-described manufacturing line by replacing the conventional equipment at annealing station 30 with one line juxtapositioner 100, and replacing the conventional equipment at buffer station 70 with another line juxtapositioner 500.

In connection with the improved annealing station 30 shown in FIG. 14, due to the very high temperatures which are needed (e.g., 500° C.), the use of an aluminum surface on the line juxtapositioner 100 is not appropriate. Instead, Inconel steel is used. And although the line juxtapositioner 100 used in annealing station 30 only shows the drum rotating, it is understood that a winder is typically used to load the drum with strand material. Moreover, drum rotation is not necessary in the annealing application when a winder 510 and an unwinder 520 (see FIGS. 5 and 6) are both used. In connection with the improved buffer station 70 shown in FIG. 14, about one minute's worth of strand material is stored on line juxtapositioner 500. This allows use of a low-speed fan to dry the strand material—which is much quieter and less costly than prior art air-wipe devices. And although the line juxtapositioner 500 used in buffer station 70 shows a winder and an unwinder, it is understood that buffering can be accomplished with only one of these devices when drum rotation is used.

Twisting Strand Material

It is not possible to impart a unidirectional twist onto a pair of wires when only mid-span access is available. Either the take-up spool needs to be twisted as an untwisted wire-pair is deposited thereon, or a pair of supply spools (each containing a single wire) need to be twisted around each other as wire is exiting. A discussion of these known twisting techniques is presented in the book series entitled "*abc of the Telephone*." In particular, reference is made to Vol. 5 entitled "*Cable, inside and out*" by Frank W. Horn.

Reference is made to FIG. 3 in order to more fully explore the possibility of twisting a pair of wires using the line juxtapositioner of the present invention. When winder 310 installs strand material onto the drum 110, it is noted that one twist per rotation of the winder is imparted onto the strand material. However this only occurs when the volume of material 200 on the drum is increasing or decreasing. For example, assume that incoming strand material 201 comprises a pair of wires, and assume that the drum is rotating in the direction shown. If the winder 310 does not rotate, then no twist will be imparted onto the wires and the volume of wire 200 on the drum will remain constant. If the winder rotates in the same direction as the drum, then a positive twist will be imparted onto the wire pair and the volume of wire on the drum will be decreasing. And if the winder rotates in a direction that is opposite the direction of drum rotation, then a negative twist will be imparted onto the wire pair and the volume of wire on the drum will be increasing.

One twisting technique uses a die (not shown) having a pair of side-by-side passageways. The die is positioned to the left of winder assembly 310 in FIG. 3, and one wire is fed through each passageway. As the winder assembly rotates, twists will accumulate between the die and pulley 312. Eventually, these twists will propagate beyond pulley 312 and onto the drum 110. The purpose of the die is to insure that twists are imparted downstream onto the wires as they are installed on the drum 110 rather than upstream.

Twisting is also accomplished by using an unwinder assembly, such as shown in FIG. 4, in much the same manner; although, in this situation, no die is used because downstream propagation of twists is desirable. Note that twisting only occurs when the volume of strand material on the drum 110 is increasing or decreasing. However, due to the large volume of strand material that can be compactly stored on the drum, it is possible to completely fill, or empty, the drum while creating a unidirectional twist. Accordingly, the present invention provides unidirectional twisting of strand material over substantially longer spans than have been possible heretofore.

Although various particular embodiments have been shown and described, it is understood that modifications may be made within the spirit and scope of the invention. These modifications include, but are not limited to, the use of apparatus other than electromagnets to move the drum surface; the use of fewer or more than six segments on the drum; the use of a non-cylindrical drum surface; and the use of materials other than those disclosed in the construction of a line juxtapositioner.

I claim:

1. A method for twisting a pair of moving strands comprising the steps of:

moving the strand pair along a path of travel through a winder assembly;

rotating the winder assembly around a central axis to impart one twist for each 360 degrees of rotation onto the strand pair;

depositing convolutions of the twisted strand pair onto an input end of a storage structure having a movable exterior surface;

vibrating the exterior surface to advance convolutions of the twisted strand pair in a longitudinal direction parallel to the central axis;

rotating the storage structure around the central axis; and moving the twisted strand pair from an output end of the storage structure to a take-up apparatus.

2. The method of claim 1 wherein the step of vibrating the exterior surface to advance convolutions of the twisted strand pair in a longitudinal direction parallel to the central axis includes the step of:

introducing cyclic oscillation to the surface of the storage structure, said cyclic oscillation residing in a plane which passes through the central axis.

3. The method of claim 1 further including the step of:

periodically reversing the direction of rotation of the winder assembly to reverse the direction of twist imparted on the strand pair; whereby the strand pair includes an S-Z twist pattern.

4. A method for twisting a pair of moving strands comprising the steps of:

moving the strand pair along a path of travel onto an input end of a storage structure having a movable exterior surface;

rotating the storage structure around its central axis to add convolutions of the strand pair onto the exterior surface;

vibrating the exterior surface to advance convolutions of the twisted strand pair in a longitudinal direction parallel to the central axis;

moving the strand pair from an output end of the storage structure onto an unwinder assembly;

rotating the unwinder assembly around the central axis to impart one twist for each 360 degrees of rotation onto the strand pair; and moving the twisted strand pair from the unwinder assembly to a take-up apparatus.

5. The method of claim 4 wherein the step of vibrating the exterior surface to advance convolutions of the twisted strand pair in a longitudinal direction parallel to the central axis includes the step of:

introducing cyclic oscillation to the exterior surface, said cyclic oscillation residing in a plane which passes through the central axis.

6. The method of claim 4 further including the step of:

periodically reversing the direction of rotation of the unwinder assembly to reverse the direction of twist imparted on the strand pair; whereby the strand pair includes an S-Z twist pattern.

7. A method for twisting a pair of moving strands comprising the steps of:

moving the strand pair along a path of travel through a winder assembly;

rotating the winder assembly in a clockwise direction around a central axis to impart one clockwise twist for each 360 degrees of rotation onto the strand pair;

depositing convolutions of the clockwise-twisted strand pair onto an input end of a storage structure having a movable exterior surface;

vibrating the exterior surface to advance convolutions of the twisted strand pair in a longitudinal direction parallel to the central axis;

removing the strand pair from the storage structure an onto an unwinder assembly;

rotating the unwinder assembly in a counterclockwise direction around the central axis to impart one counterclockwise twist for each 360 degrees of rotation onto the strand pair; and moving the twisted strand pair from the unwinder assembly to a take-up apparatus.

8. The method of claim 7 further including the step of periodically reversing the direction of rotation of the winder assembly to reverse the direction of the resulting twist.

9. The method of claim 7 further including the step of periodically reversing the direction of rotation of the unwinder assembly to reverse the direction of the resulting twist.

10. The method of claim 7 further including the step of periodically reversing the direction of rotation of the winder and unwinder assemblies to reverse the direction of the resulting twist.

11. The method of claim 7 further including the step of:

rotating the storage structure at a predetermined rate about the central axis.

12. A method for imparting an S-Z twist onto a pair of moving wires comprising the steps of:

moving the wire pair along a path of travel through a winder assembly;

during a first time interval, rotating the winder assembly in a clockwise direction around a central axis to impart one clockwise twist for each 360 degrees of rotation onto the wire pair;

depositing convolutions of the clockwise-twisted wire pair onto an input end of a storage structure having a movable exterior surface;

vibrating the exterior surface of the storage structure to advance convolutions of the twisted wire pair from the input end to an output end thereof;

during a second time interval, rotating the winder assembly in a counterclockwise direction around the central axis to impart one counterclockwise twist for each 360 degrees of rotation onto the wire pair; and moving the twisted wire pair from the output end of the storage structure to a take-up apparatus.

* * * * *